US008910820B2

(12) United States Patent
Sharpe

(10) Patent No.: US 8,910,820 B2
(45) Date of Patent: Dec. 16, 2014

(54) LIFE SAFETY MOUNTING SYSTEM AND METHOD

(75) Inventor: Jason Michael Sharpe, Colorado Springs, CO (US)

(73) Assignee: UTC Fire & Security Corporation, Farmington, CT (US)

( * ) Notice: Subject to any disclaimer, the term of this patent is extended or adjusted under 35 U.S.C. 154(b) by 437 days.

(21) Appl. No.: 12/734,369

(22) PCT Filed: Oct. 29, 2007

(86) PCT No.: PCT/US2007/022797

§ 371 (c)(1), (2), (4) Date: Apr. 27, 2010

(87) PCT Pub. No.: WO2009/058109

PCT Pub. Date: May 7, 2009

(65) Prior Publication Data

US 2010/0230412 A1 Sep. 16, 2010

(51) Int. Cl.
*B65D 25/24* (2006.01)
*G08B 17/10* (2006.01)

(52) U.S. Cl.
CPC ..... *G08B 17/10* (2013.01)
USPC ..... 220/481; 340/693.6; 340/693.11; 340/628

(58) Field of Classification Search
USPC ..... 220/481; 340/693.6, 628, 693.5, 693.7, 340/693.9, 693.11; 248/229.11, 343, 344, 248/222.52, 354.3; 411/349
See application file for complete search history.

(56) References Cited

U.S. PATENT DOCUMENTS

| | | | | |
|---|---|---|---|---|
| 1,819,460 | A | 8/1931 | Frank | |
| 4,424,553 | A | 1/1984 | Marsocci et al. | |
| D319,600 | S | 9/1991 | Kaiser et al. | |
| 5,529,273 | A * | 6/1996 | Benthin | 248/254 |
| 5,563,766 | A | 10/1996 | Long et al. | |
| 5,979,854 | A * | 11/1999 | Lundgren et al. | 248/354.3 |
| 6,160,487 | A * | 12/2000 | DeLuca | 340/693.7 |
| 6,271,763 | B1 * | 8/2001 | Hur | 340/693.12 |
| 7,034,702 | B2 * | 4/2006 | Thomas et al. | 340/628 |
| 7,109,880 | B2 * | 9/2006 | Sibalich et al. | 340/693.6 |
| 7,193,507 | B2 * | 3/2007 | Yu | 340/391.1 |
| 8,015,873 | B2 * | 9/2011 | Hall et al. | 73/431 |

FOREIGN PATENT DOCUMENTS

DE 202004019995 U 3/2005

OTHER PUBLICATIONS

Office Action dated Jun. 8, 2012, Great Britain Application No. 061008402.8, 3 pages.

* cited by examiner

*Primary Examiner* — Luan K Bui
*Assistant Examiner* — Rafael Ortiz
(74) *Attorney, Agent, or Firm* — Cantor Colburn LLP

(57) ABSTRACT

A life safety assembly includes an attachment stud configured to attach to a surface, and a life safety device that is mountable on the attachment stud. The life safety device has a receptacle configured to receive and interlock with the attachment stud to mount the life safety device with respect to the surface.

13 Claims, 14 Drawing Sheets

LIFE SAFETY MOUNTING SYSTEM AND METHOD

BACKGROUND

The invention relates to a mounting system for a life safety device. In particular, the invention relates to an attachment stud that can be attached to a ceiling or wall utilizing only a single screw, and a life safety device that can be mounted to the attachment stud and rotated for cosmetic alignment.

Life safety devices, including smoke alarms and carbon monoxide detectors, typically have a mounting plate to attach the smoke alarm to a surface such as a ceiling or wall. These plates generally utilize at least two screws to mount the plate to the surface. The multi-screw design increases the installation time for the mounting plate, as it is necessary to align the mounting plate such that the life safety device assembly will be cosmetically appealing once installed. Cosmetic alignment is of particular concern if a non-circular life safety device housing is utilized, because to achieve cosmetic alignment, it may be necessary to align the edge of the device parallel to another surface, such as a nearby wall. To mount the assembly in a cosmetically appealing manner, it is often necessary with a multi-screw design to first climb a ladder and place the mounting plate on a surface, review the placement of the mounting plate to ensure it will produce the desired alignment of the life safety device, mark the location of the multiple screw holes that must be drilled into the surface, drill multiple holes, place wall anchors in the holes, re-align the mounting plate with the holes drilled in the surface, and insert the screws into the wall anchors. This entire process can be time consuming, especially if the alignment of the life safety device after installation proves not to be cosmetically pleasing, and it is necessary to re-align the assembly.

To attach the life safety device to the mounting plate, it is also often necessary to align the life safety device such that the unit fits into (or on) a specific location on the mounting plate such as a tab, lip, slot or recess. To mount the assembly, it may be necessary to rotate the life safety device to a specific angle so that the slot, dimple, or tab on the life safety device comes into contact with the lip, projection, or recess on the mounting plate. This mounting arrangement limits the angle to which the life safety device can be rotated, often making it difficult to achieve cosmetically pleasing alignment of the assembly.

SUMMARY

A life safety assembly includes an attachment stud configured to attach to a surface such as a wall or ceiling, and a life safety device that is mountable on the attachment stud. The life safety device has a receptacle configured to receive and interlock with the attachment stud to mount the life safety device with respect to the surface.

A method of mounting a life safety device assembly, the method includes mounting an attachment stud to a surface and then mounting a life safety device onto the attachment stud. The life safety device is mounted to the attachment stud so that the attachment stud projects into a receptacle. The life safety device is rotated about an axis defined by the stud to a position in which the stud and the receptacle are interlocked.

DETAILED DESCRIPTION

Figure 1A:
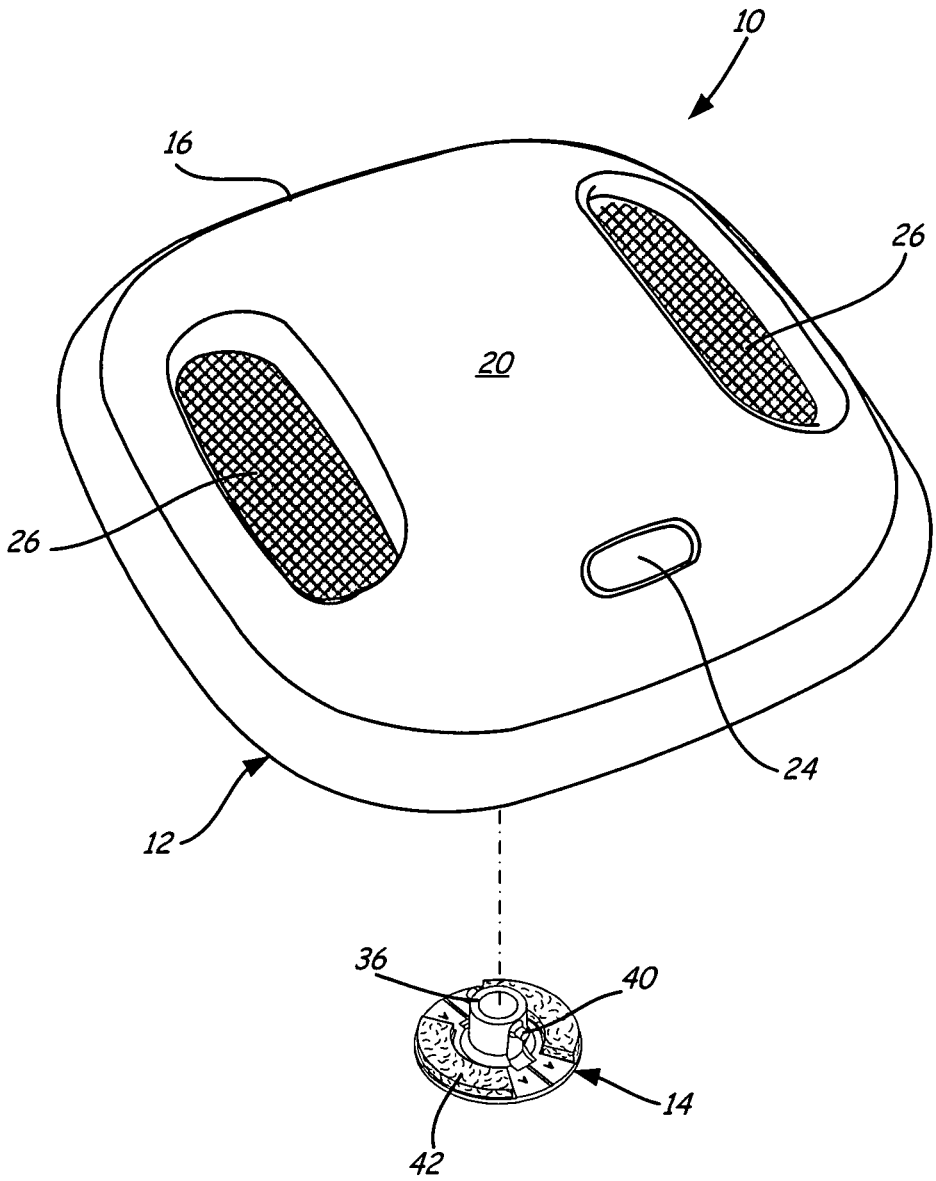
FIGS. 1A and 1B shows front and back exploded perspective views of a life safety assembly that includes an attachment stud and a life safety device.
Figure 1B:
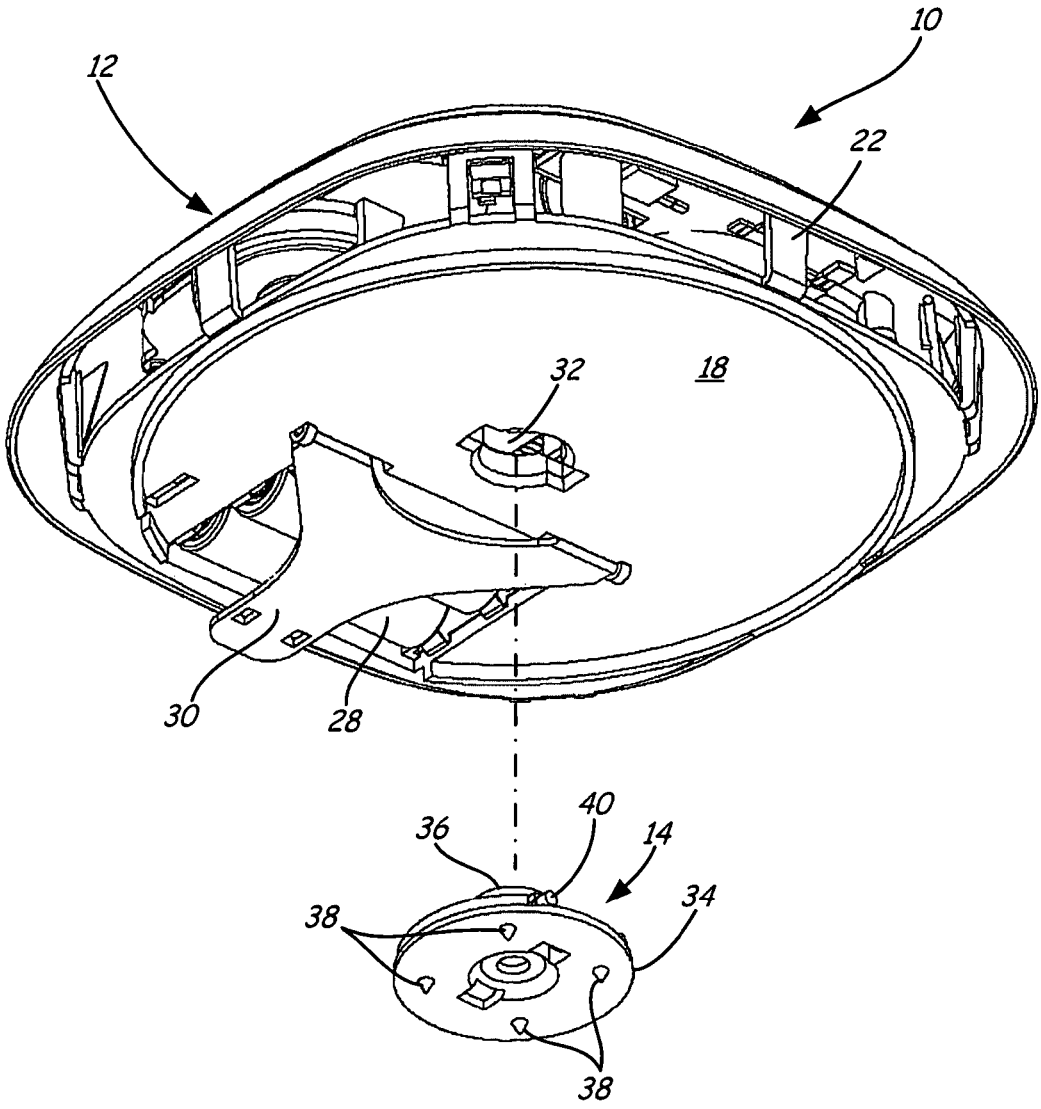

FIGS. 1A and 1B show exploded views of a life safety device assembly 10 including a life safety device 12 and an attachment stud 14. The life safety device 12 includes a housing 16 formed by a base surface 18, front cover 20 and side wall supports or spacers 22. The side wall spacers 22 define an interior compartment for electronic components, and allow smoke or carbon monoxide to more effectively reach a sensor inside the life safety device 12. The electronic equipment components may include, for example: a sensor, an alarm, signal processing circuitry, and batteries. Other features of the assembly may include: an alarm test button 24, speaker covers 26, battery compartment 28, battery door 30, and mounting receptacle 32. Other features and components may be available in other embodiments.

FIGS. 1A and 1B illustrate an embodiment of an attachment stud 14, the attachment stud 14 includes a base plate 34, post 36, attachment cleats 38, mounting tabs or keys 40. The attachment stud 14 attaches to a surface, such as a wall or ceiling, and provides a connection for mounting the life safety device 12 to the surface. In one embodiment, the attachment stud 14 fastens to the wall or ceiling surface using only a single screw, which provides for quick and easy mounting of the attachment stud 14.

In one embodiment, the life safety assembly 10 includes a compressible material affixed to the life safety device 12 or the attachment stud 14, the compressible material is capable of creating an opposing force between the life safety device 12 and the attachment stud 14 when the life safety device 12 and the attachment stud 14 are mounted. FIGS. 1A and 1B illustrate an embodiment in which the compressible material is affixed to the base plate 34 and is a base foam 42.

The life safety device 12 can be quickly and easily mounted to the attachment stud 14 by placing the life safety device 12 on the attachment stud 14 and rotating the life safety device 12 to one of a plurality of positions. The ability of the life safety device 12 to be rotated to a plurality of positions with respect to the attachment stud 14 allows the assembly 10 to be quickly and easily cosmetically aligned. For example, an edge of the assembly 10 may be quickly and easily aligned to be substantially parallel or perpendicular to another surface such as an adjacent wall or ceiling.

Figure 2A:
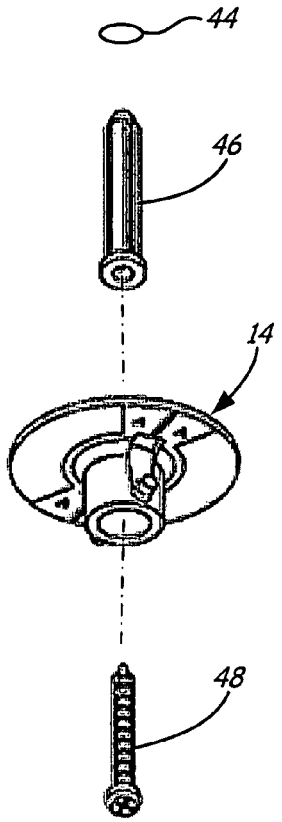
FIGS. 2A, 2B and 2C illustrate a method of mounting the life safety assembly of FIGS. 1A and 1B.
Figure 2B:
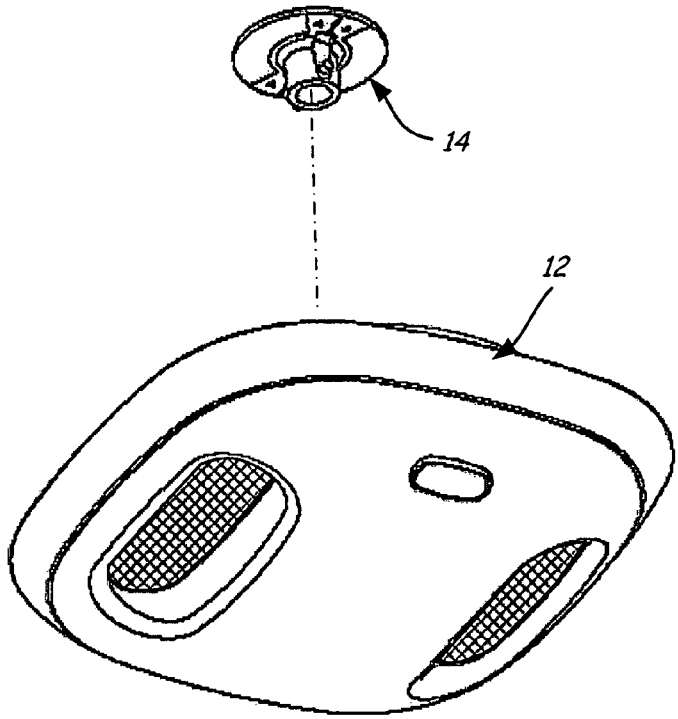
Figure 2C:
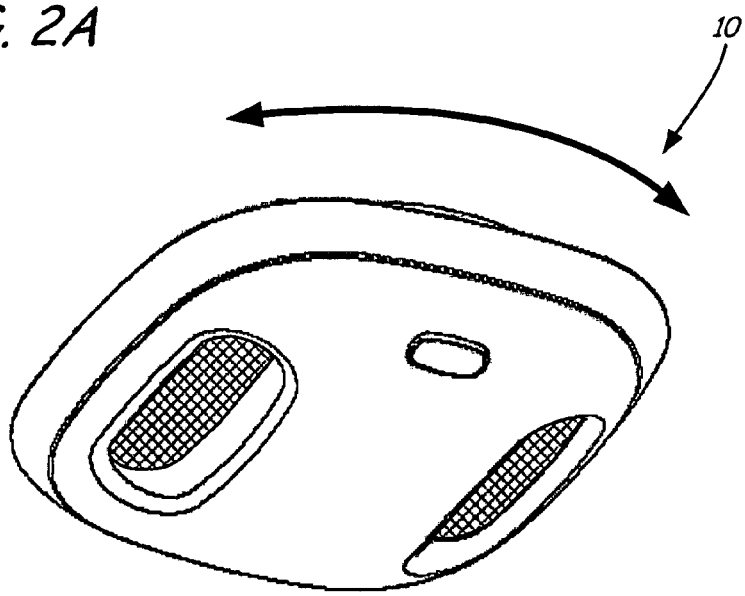

FIGS. 2A-2C illustrate a method of mounting the life safety assembly 10 to a surface such as a ceiling or wall. A hole 44 is drilled in the surface. A wall anchor 46 is placed into the hole 44, preferably to its full depth. A hole in the post 36 of the attachment stud 14 is then aligned with the hole 44 and the wall anchor 46. A single fastening screw 48 is then inserted through the attachment stud 14. The screw 48 is tightened, fastening the attachment stud 14 to the wall anchor 46. Before tightening the fastening screw 48, the attachment stud 14 may be aligned for cosmetic purposes.

In FIGS. 2B and 2C, the attachment stud 14 has initially been mounted to the mounting surface using the method shown in FIG. 2A. In FIG. 2B, the life safety device 12 is moved to a position where the mounting receptacle 32 on the life safety device 12 is aligned with the projecting post 36 and mounting tabs 40 of the attachment stud 14. The life safety device 12 is disposed such that the mounting tabs 40 and post 36 pass into a compartment of the mounting receptacle 32. Once the attachment stud 14 has entered the compartment, the base plate 34, base foam 42, or an interior stop may be contacted, this contact indicates to the individual installing the life safety device 12 that the movement of the life safety device 12 onto the mounting stud 14 should cease. The interior stop may also indicate that a position adequate for securely mounting the life safety device 12 to the attachment stud 14 has been achieved. If the base foam 42 is contacted by the base surface 18 of the life safety device 12, it may be necessary to compress the foam 42 slightly before rotation of the life safety device 12 with respect to the attachment stud 14 can be completed. FIG. 2C shows the life safety device 12 being rotated to interlock with the attachment stud 14.

FIGS. 3 through 6 illustrate an embodiment of the attachment stud 14 with features in addition to the base plate 34, post 36, attachment cleats 38, mounting tabs 40, and base foam 42, including: an alignment mark 50, a counter bore 52, a chamfer 54, and a thru hole 56. The attachment stud 14 may be formed of any thermoplastic polymer such as a polycarbonate or polyvinyl chloride. In one embodiment, the attachment stud is formed utilizing injection molded LEXAN.

Figure 3:
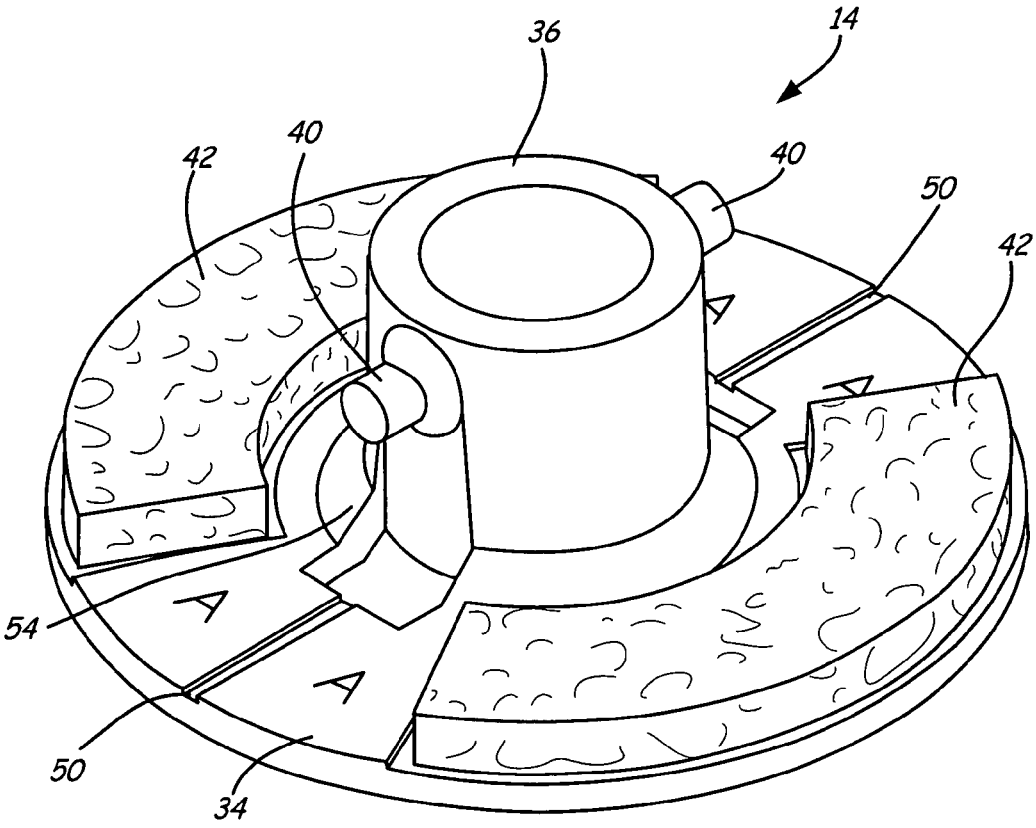
FIG. 3 is a front perspective view of the attachment stud.

In FIG. 3, the base plate 34 has foam 42 attached. The foam 42 (in one embodiment polyurethane foam) is attached with industrial glue or adhesive tape. The foam 42 closes any clearances that may result from the mounting of the life safety device 12 onto the attachment stud 14. The foam 42 closes the clearances by compressing slightly when the life safety device 12 is mounted. The compression of the foam 42 creates an opposing force that is applied to the interior of the life safety device 12 via the mounting tabs 40 of the attachment stud 14. The foam 42 also creates a frictional force between the base surface 18 and the foam 42 that is greater than the force that would otherwise exist between the life safety device 12 and the base plate 34 alone. The additional frictional force may be used to keep the life safety device 12 from rotating and disengaging from the attachment stud 14.

Figure 4:
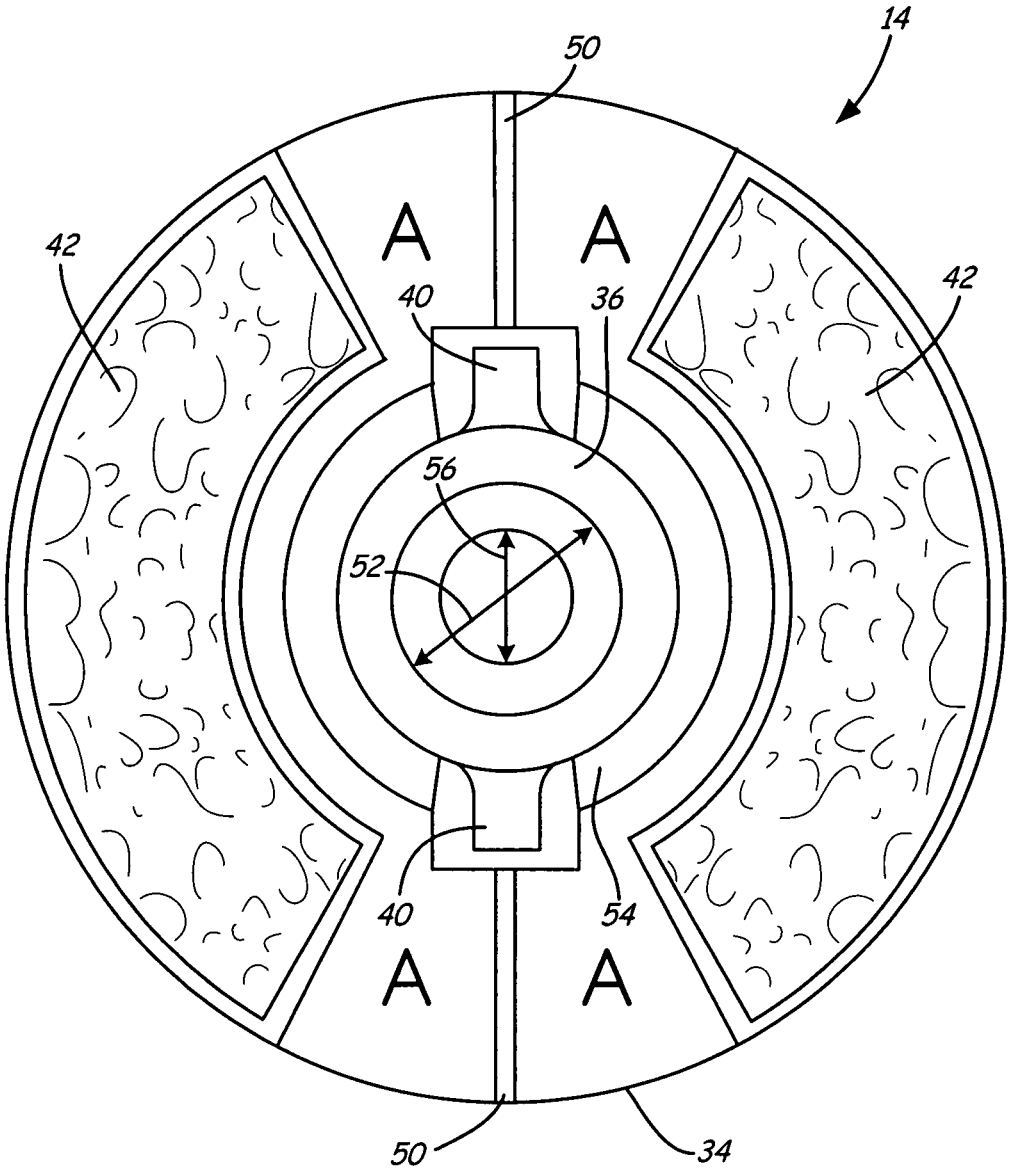
FIG. 4 is a front view of the attachment stud.

FIGS. 3 and 4 show an alignment mark 50 on the base plate 34. The alignment mark 50 may be used to achieve cosmetic alignment of the mounted life safety device 12, for example by aligning the alignment mark 50 with a surface such as a wall or ceiling running parallel to the mark 50. Alternatively, the mounting tabs 40 may be used as a reference for alignment of the stud 14. Areas of the base plate 34 not designated to be covered by foam 42 or the alignment mark 50 may be marked with an indicator such as an "A" to ease assembly of the attachment stud 14. The base plate 34 interconnects with a chamfer 54 that provides for clearance in the event that a wall anchor is left proud on the attachment surface. The chamfer 54 interconnects with the projecting post 36. The post 36 creates the projection that is inserted into the interior of the life safety device 12 to mount the assembly 10 to a surface.

FIG. 4 shows a thru hole 56 and the counter bore 52 located inside the projecting post 36 of the attachment stud 14. In the embodiment shown, the thru hole 56 is located on an axis of symmetry of the attachment stud 14. In other embodiments, the thru hole 56 may be located on another area of the attachment stud 14 such as the base plate 34. Together, the post 36 and chamfer 54 create a recess used for clearance in the event that a wall anchor is left proud on the attachment surface. The counter bore 52 engages the back head of the fastening screw and secures the attachment stud 14 to the mounting surface.

Figure 5:
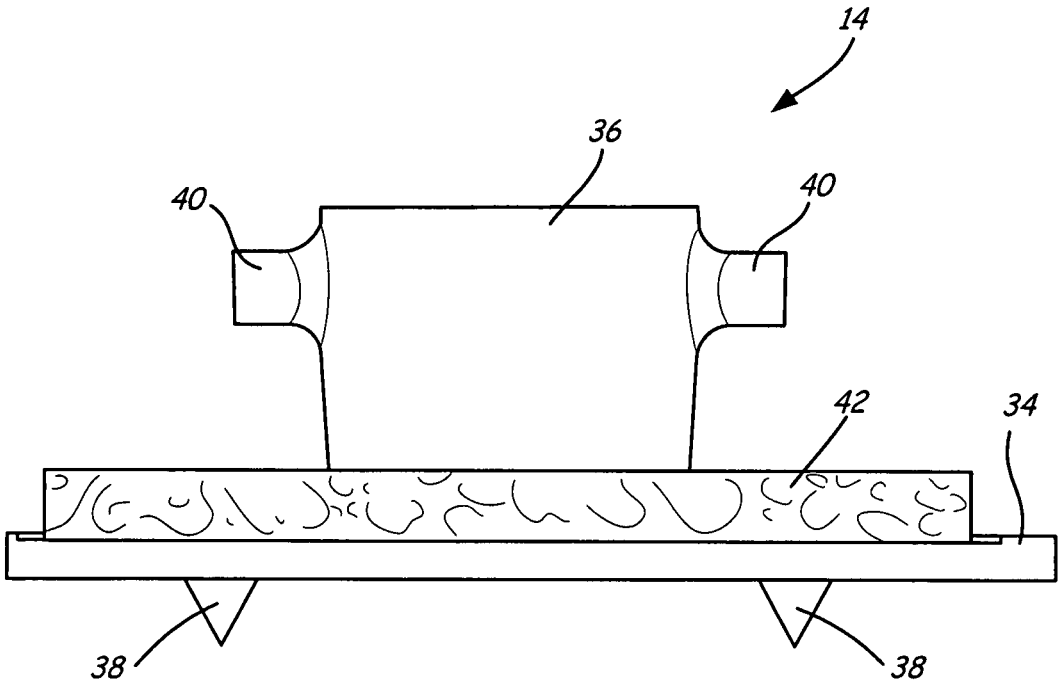
FIG. 5 is a side elevation view of the attachment stud.

As illustrated in FIG. 5, the projecting post 36 has mounting tabs or keys 40 projecting from the surface of the post 36. The mounting tabs 40 are generally cylindrical in shape (save for a tapered base area on the tabs) and project generally perpendicularly from the side surface of the post 36. The mounting tabs 40 provide a surface for engaging the life safety device 12 to mount the life safety device 12 to attachment stud 14. In other embodiments, the mounting tabs 40 may be provided with other shapes and/or projection angles with relation to the surface of the post 36 to mount the life safety device 12 to the attachment stud 14. FIG. 5 shows the mounting tabs 40 may be located near the top of the projecting post 36, however, other mounting tab 40 locations along the post 36 may be possible.

Figure 6:
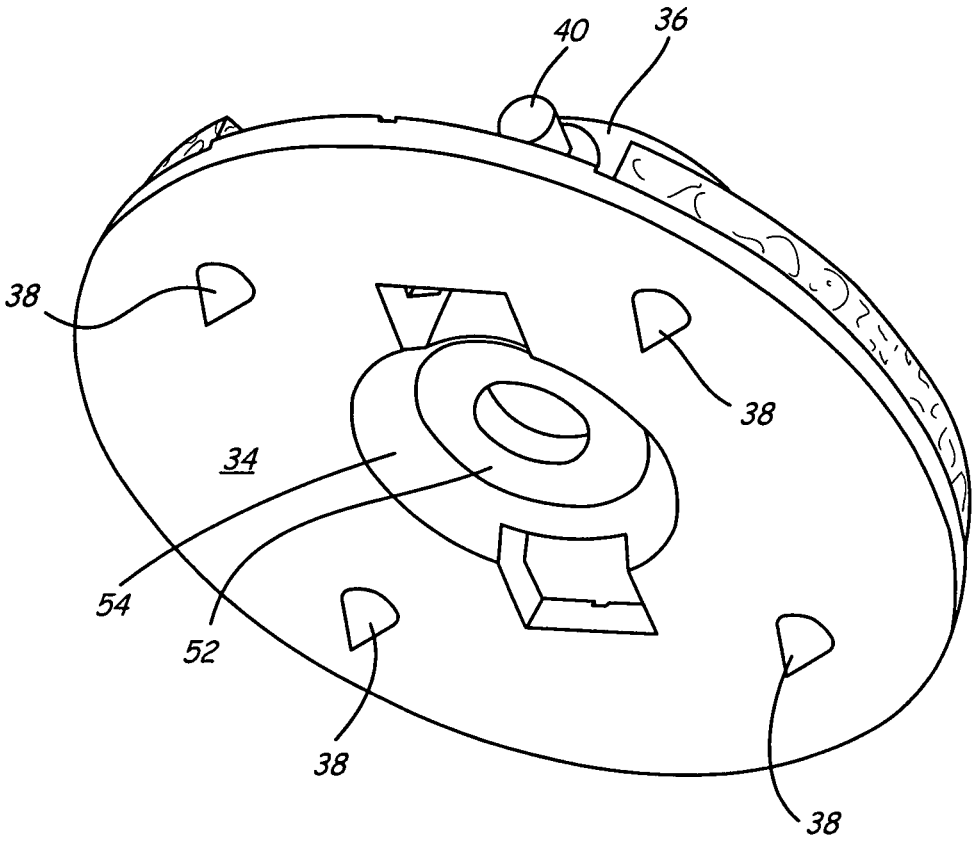
FIG. 6 is a back perspective view of the attachment stud.

In FIGS. 5 and 6, attachment cleats 38 are arrayed on the bottom of the base plate 34. The attachment cleats 38 are used to gain purchase on the mounting surface to prevent the mounting stud 14 from rotating during installation. FIG. 6 better illustrates the recess that the counter bore 52 and chamfer 54 creates between the base of the attachment stud 14 and the mounting surface. The clearance may be used in the event that a wall anchor is left proud on the mounting surface.

FIGS. 7 through 10 illustrate the base surface 18 of the life safety device 12. The base surface 18 includes the side wall supports 22, a base plate 58, and a skirt 60. The base plate 58 includes major features such as: the mounting receptacle 32, battery compartment 28 and a lockout mechanism 62. As illustrated in FIGS. 8A and 8B, the lockout mechanism 62 comprises a track 64, a crossbar 66, a slider mechanism 68, a guide and stop 70, a hook 72, a spring 74, a spring clip 76, and a lockout tab 78. The mounting receptacle 32 includes a bore 80, a pair of keyways 82, two collar halves 84 (the collar halves 84 have a series of wave-like detents 86 that together with the collars 84 form a lock), ramps 88, and an interior stop 90 with supports 91 that support the interior stop 90. In FIGS. 8A, 8B, 9A, and 9B, the battery compartment includes a top wall 92, side walls 94, end walls 96, a window 98, electrically conductive terminals 100, and batteries 102.

Figure 7:
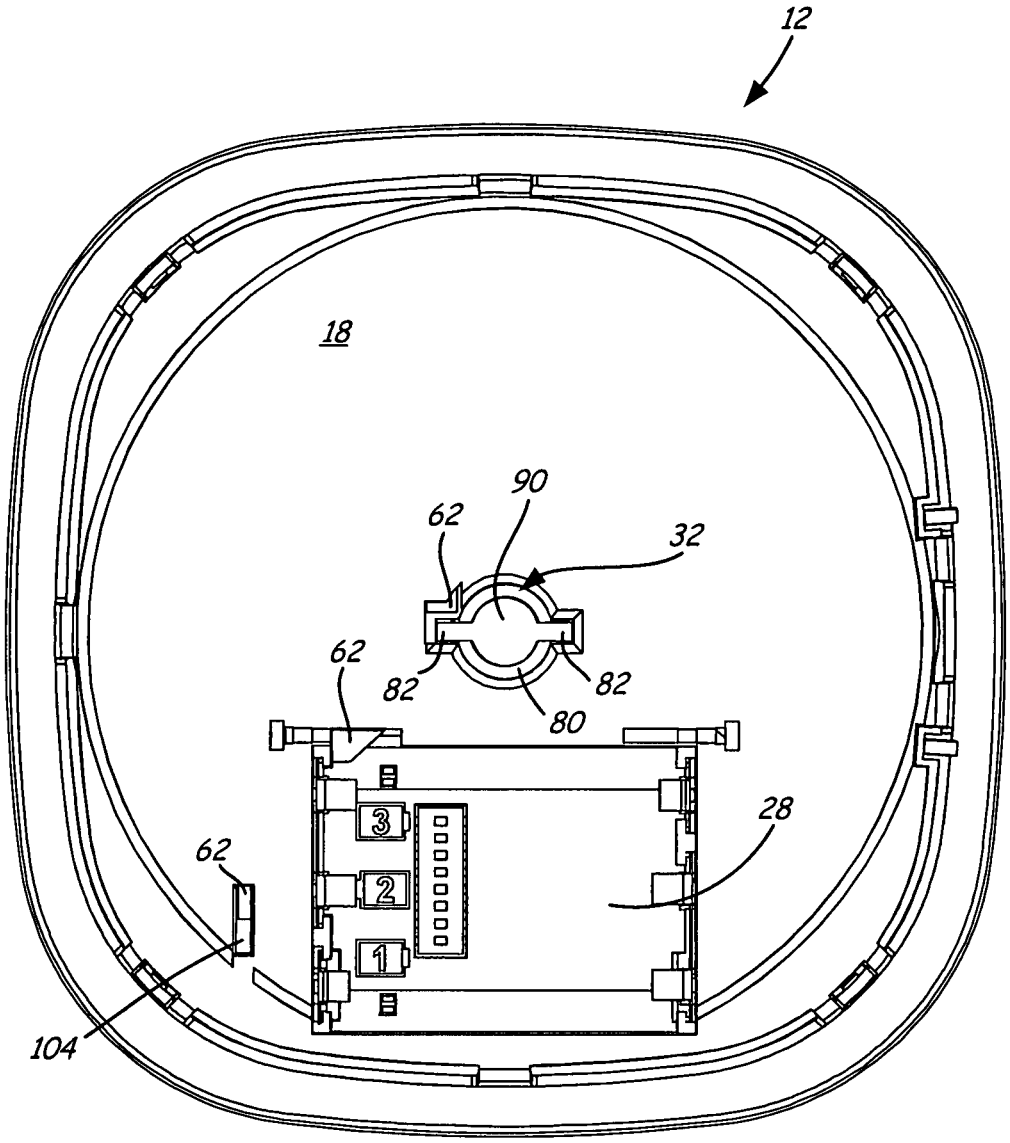
FIG. 7 is a view of a back surface of the life safety device.

FIG. 7 shows the generally planar base surface 18 of the life safety device 12 with the receptacle 32, which allows the attachment stud 14 to enter an interior compartment of the life safety device 12. The base surface 18 may be molded from any thermoplastic polymer. In one embodiment, the life safety device 12 is formed utilizing injection molded LEXAN. The base surface 18 may be pressed against the base plate 34 or the attachment foam 42 during mounting of the life safety device 12 to the attachment stud 14. The receptacle 32 on the base surface 18 has enough clearance to allow the post 36 and mounting tabs 40 of the attachment stud 14 to enter the interior of the life safety device 12. The base surface 18 also has a recess that comprises the battery compartment 28. The shape and location of the battery compartment 28 may be modified to accommodate a different model battery other then the AA battery design shown. In FIG. 7, a portion of the lockout mechanism 62 is illustrated recessed in a slot 104 in the base surface 18. The slot 104 retains the lockout mechanism 62 and provides a space for the lockout mechanism 62 to slide from an obstructing to a non-obstructing position. In FIG. 7, the lockout mechanism 62 is shown in an obstructing position with regard to the receptacle 32 and the battery compartment 28.

Figure 8A:
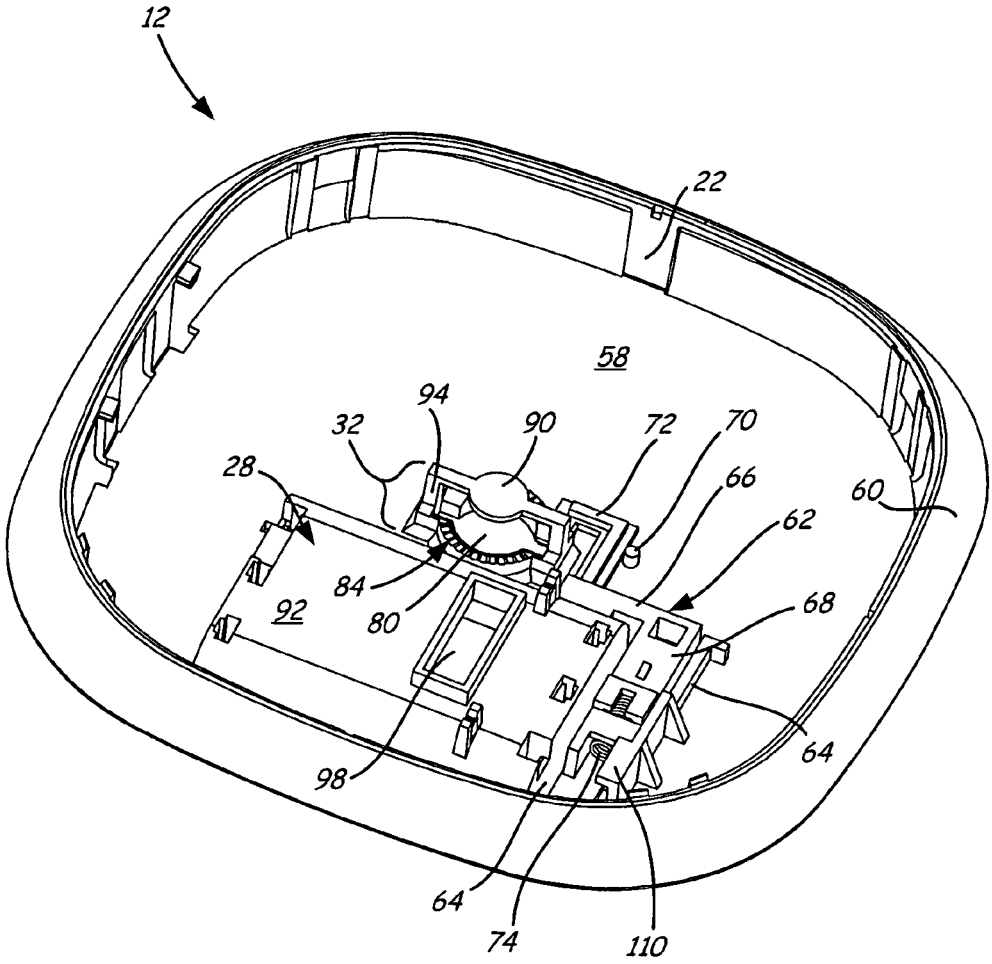
FIGS. 8A and 8B show perspective views of an interior compartment of the life safety device with a spring clip installed and removed from a portion of a lockout mechanism.
Figure 8B:
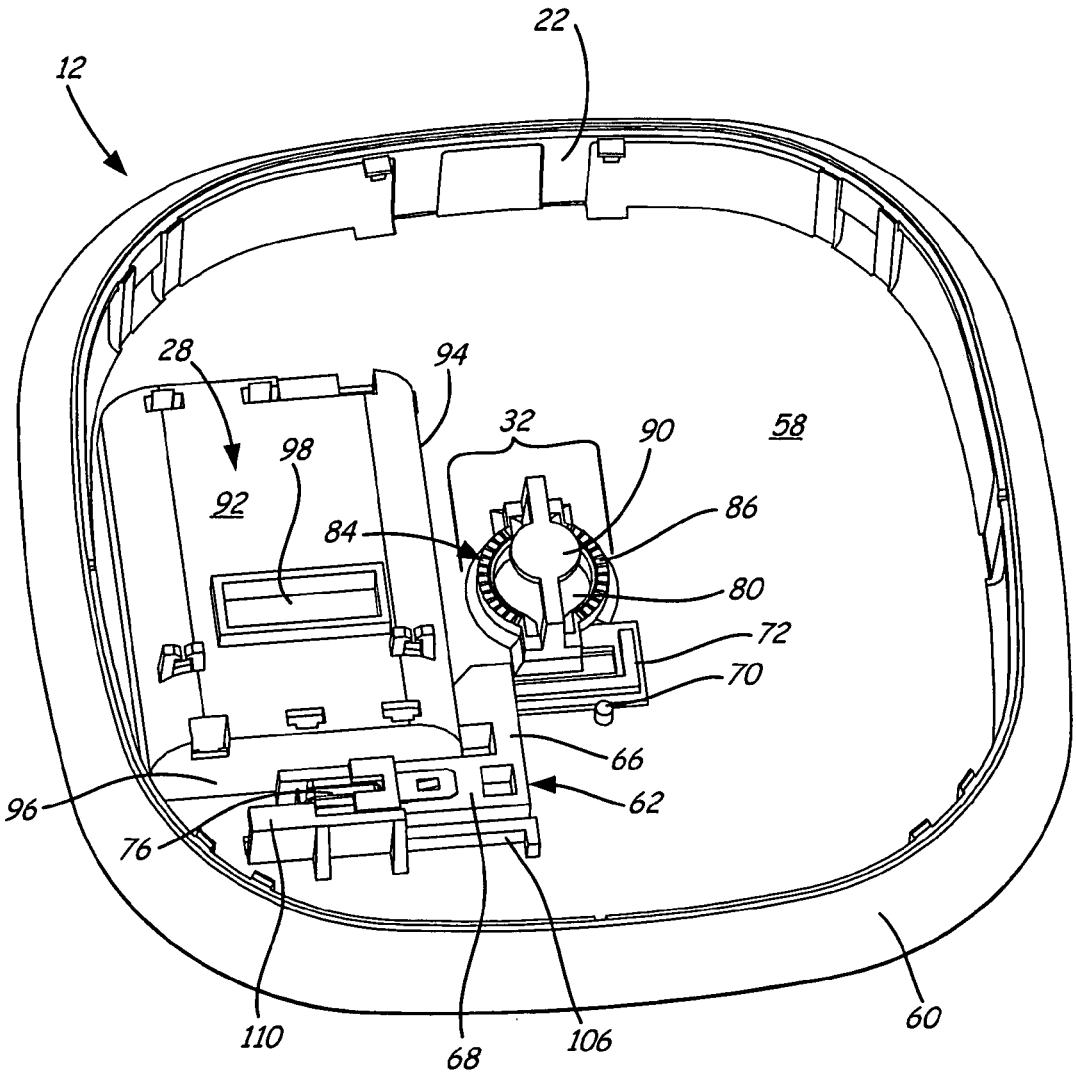

FIGS. 8A and 8B show the interior of the life safety device 12 with the front cover 20 and electronic components removed. The base plate 58 interconnects with the side wall supports 22. The side wall supports 22 interconnect with the skirt 60. The skirt 60 has tabs and recesses that allow the skirt 60 to interconnect with the front cover 20 (not shown). As illustrated, the base plate 58 has an interior projection that comprises the top wall 92, side walls 94, end walls 96, and window 98, of the battery compartment 28. The battery compartment 28 projects into the interior of the life safety device 12 to keep the batteries flush with the base surface 18 of the life safety device 12.

The base plate 58 also has a projection that comprises the receptacle 32. The receptacle 32 includes the bore 80 and keyways 82, which allow for insertion of the post 36 and mounting tabs 40. The edge of the receptacle 32 also forms two collar halves 84 adjacent the bore 80. The collar halves 84 have a series of wave-like detents 86 on the surface of the collar 84. Each detent 86 on the first collar half 84 is aligned 180 degrees from a corresponding detent 86 on the second collar half 84. The collar halves 84 and detents 86 collectively form a lock adjacent the bore 80 on which the mounting tabs 40 interlock with the life safety device 12. The receptacle 32 may include an interior stop 90; the interior stop 90 is disposed on supports 91 over the bore 80 and keyways 82. This interior stop 90 may be contacted by the post 36 of the mounting stud 14. The contact may be used to indicate that the relative position of the mounting tabs 40 and the collar halves 84 are sufficient to securely mount the life safety device 12 onto the attachment stud 14.

FIGS. 8A and 8B also further illustrate the battery lockout mechanism 62 in the interior compartment of the life safety device 12. In FIG. 8A, the spring clip 76 is removed to illustrate the coil spring 74 that biases the battery lockout mechanism 62. If one or more batteries are missing from the battery compartment 28, the mechanism 62 prevents the battery compartment from being closed, and prevents the life safety device 12 from being mounted to the attachment stud 14. The mechanism 62 includes a track 64 comprised by the end wall 96 of the battery compartment 28, and a rail 106. The end wall 96 and rail 106 allow the slider mechanism 68 located there between, to slideably move between obstructing and non-obstructing positions. The rail 106 includes a flange projection 110. The flange projection 110 and the slot 104 retain the slider mechanism 68 against the base plate 58. The crossbar 66 extends generally parallel to a portion of the side wall 91 and terminates near the base of the receptacle 32. The crossbar 66 slides between the side wall 94 of the battery compartment 28 and the guide and stop 70. The movement of the crossbar 66 from these two positions corresponds to the movement of the slider mechanism 68 from an obstructing to a non-obstructing position. The crossbar 66 interconnects with the hook 72. The hook 72 transfers movement of the crossbar 66 and slider mechanism 68 around the edge of the receptacle 32 and into a lockout slot 108, where the hook 72 interconnects with the lockout tab 78. The guide and stop 70 retains and guides the hook 72 so that hook 72 slides on a path generally parallel to the path of the slider mechanism 68. The guide and stop 70 may arrest the movement of the crossbar 66 away from the side wall 94 when the slider mechanism 68 moves to a non-obstructing position.

FIG. 8B illustrates the battery lockout mechanism 62 including the spring clip 76. The lockout mechanism 62 is initially biased toward an obstructing position by the resilient metal coil spring 70 utilizing the spring clip 76. The spring clip 76 is secured to the slider mechanism 68 to retain the spring 70 inside a cavity. The clip 76 has a sliding strip portion that slides through a slit molded into the top portion of the slider mechanism 68. The slider mechanism 62 has a latch projection onto which an opening of the strip portion of the clip snaps to secure the clip 76 to the lockout mechanism 62. The clip 76 also includes a retaining portion extending generally perpendicular to the strip portion of the clip 76 to engage the spring 70 and transfer the spring force to the mechanism 62.

Figure 9A:
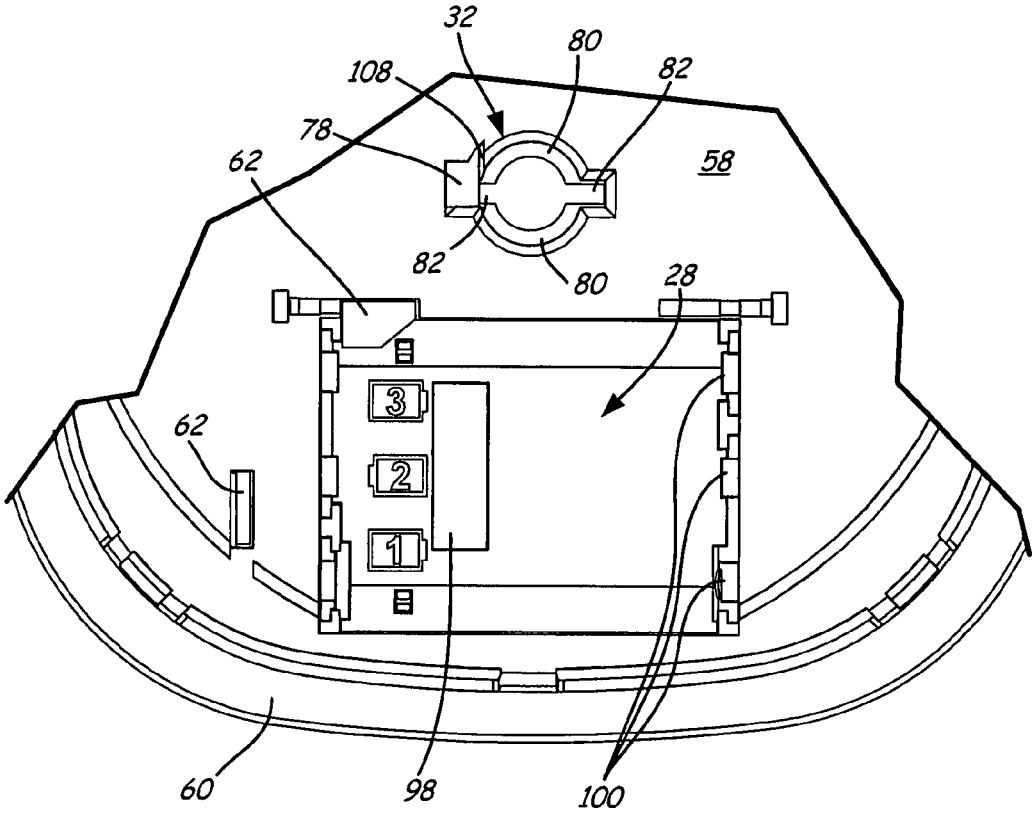
FIGS. 9A and 9B show the back surface of the life safety device with the lockout mechanism in an obstructing and non-obstructing position.

FIG. 9A illustrates the lockout mechanism 62 in an obstructing position. The base surface 18 of the life safety device 12 is illustrated in FIG. 8A with one of the keyways 82 obstructed by the lockout tab 78. In the obstructing position, the lockout tab 78 enters and obstructs the keyway 82 through the lockout slot 108 in a side of the keyway 82. Other means of locking out the life safety device 12 may include using the lockout tab 78 to obstruct other portions of the receptacle 32. For example, the bore 80 rather than the keyway 82 may be obstructed. Additionally, the lockout tab 78 could cover the top of the bore 80 or keyway 82 rather than utilizing the lockout slot 108. The obstruction of the keyway 82 by the lockout tab 78, makes it impossible for the projecting post 36 and mounting tabs 40 of the attachment stud 14 to enter the receptacle 32 and the interior of the life safety device 12. The edge of the battery lockout mechanism 62 also projects into the battery compartment 28, the mechanism 62 prevents the battery door 30 (FIG. 1B) from being closed unless all the batteries are placed in the battery compartment 28. The edge battery lockout mechanism 62 interferes with a pin molded into the base surface 18 so that the battery door 30 (FIG. 1B) cannot swivel on the pin. When all the battery regions are filled, the portion of the lockout mechanism 62 that extends into the battery region is displaced by the battery allowing the battery door 30 to close.

Figure 9B:
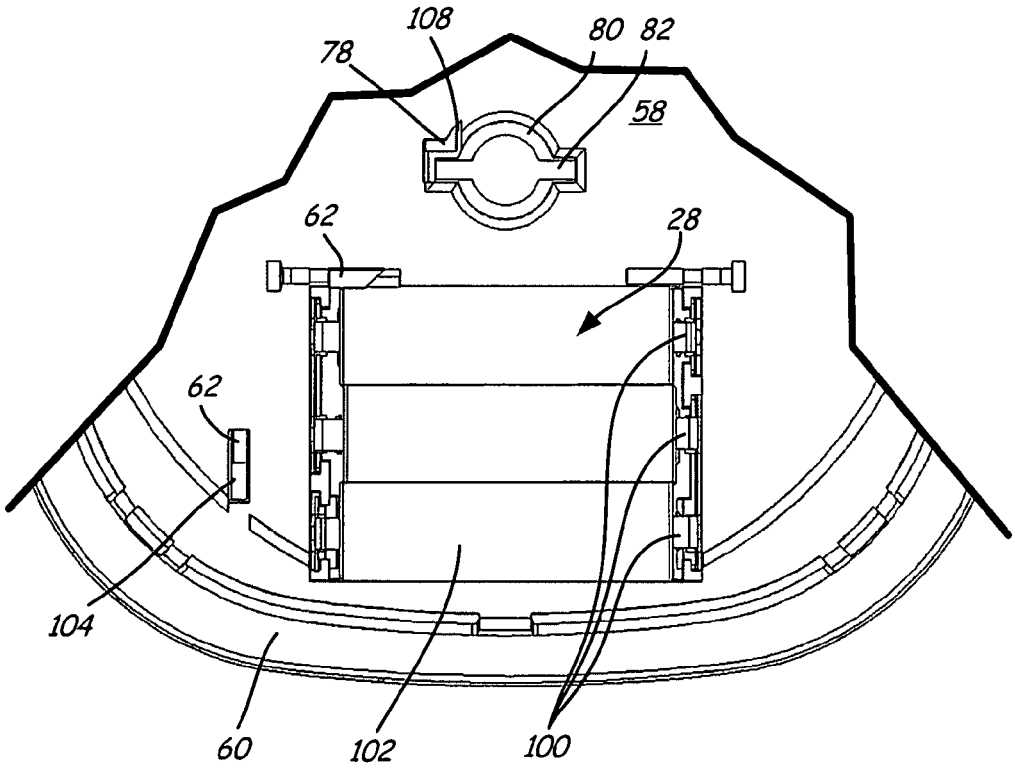

FIG. 9B illustrates the lockout mechanism 62 in a non-obstructing position. The batteries 102 have been inserted into the battery compartment 28 and make contact with the electrical conductive terminals 100. The electrical conductive terminals 100 are operatively connected to power the electronic components in the interior compartment of the life safety device 12. The portion of the lockout mechanism 62 that extends into the battery compartment 28 is displaced by the battery 102. The spring bias of the mechanism 62 is overcome by the battery 102, and the lockout tab 78 slides through the lockout slot 108 into a non-obstructing position.

Figure 10A:
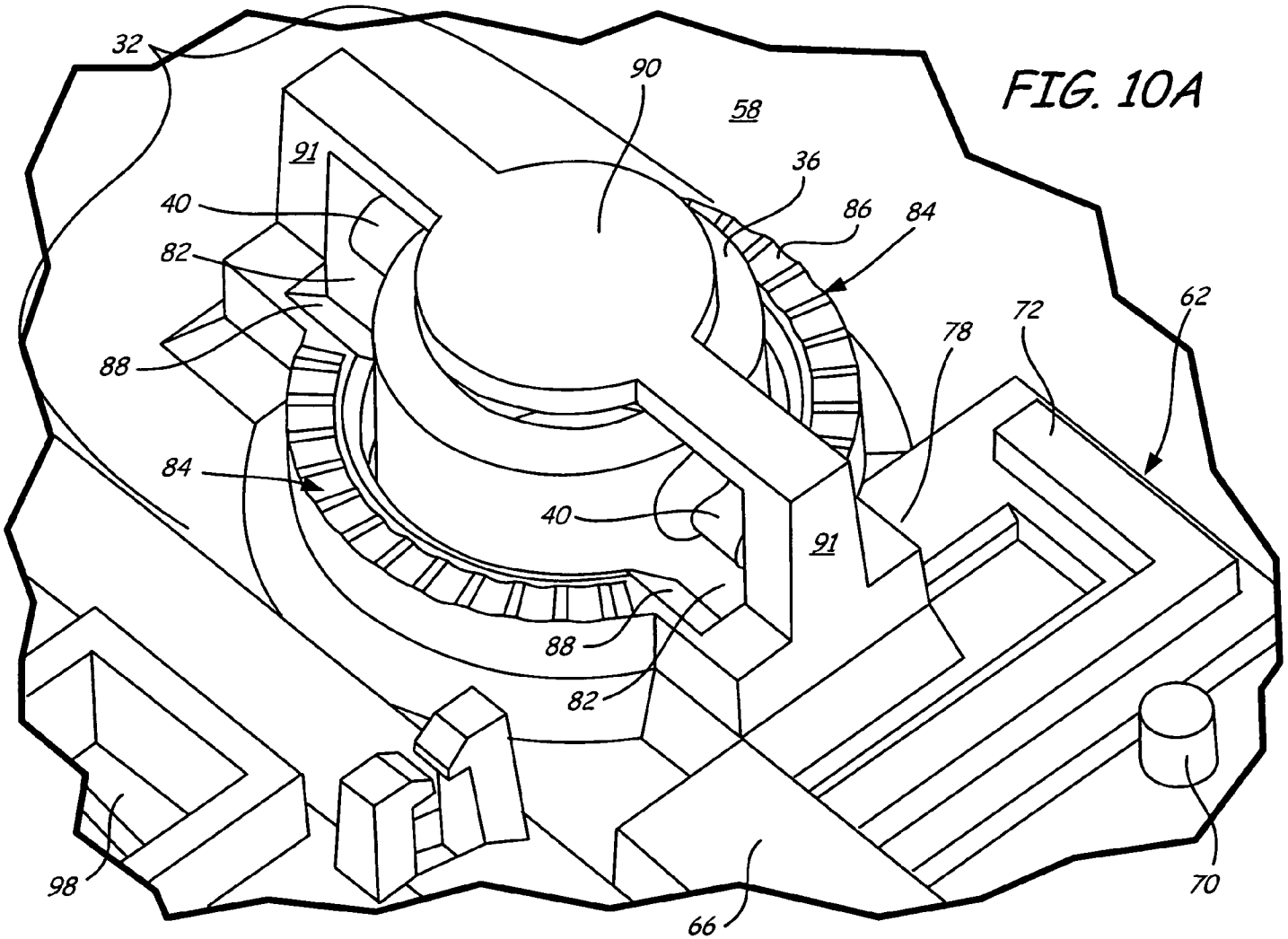
FIGS. 10A and 10B are perspective views of the attachment stud inserted into and rotated inside a receptacle of the life safety device.

FIG. 10A is a perspective view of the projection post 36 and mounting tabs 40 inserted into the receptacle 32, but without the life safety device 12 having been rotated to interlock with the attachment stud 14. In FIG. 10A, mounting tabs 40 are aligned with keyways 82, as is required when engaging or disengaging the life safety device 12 and the attachment stud 14.

Figure 10B:
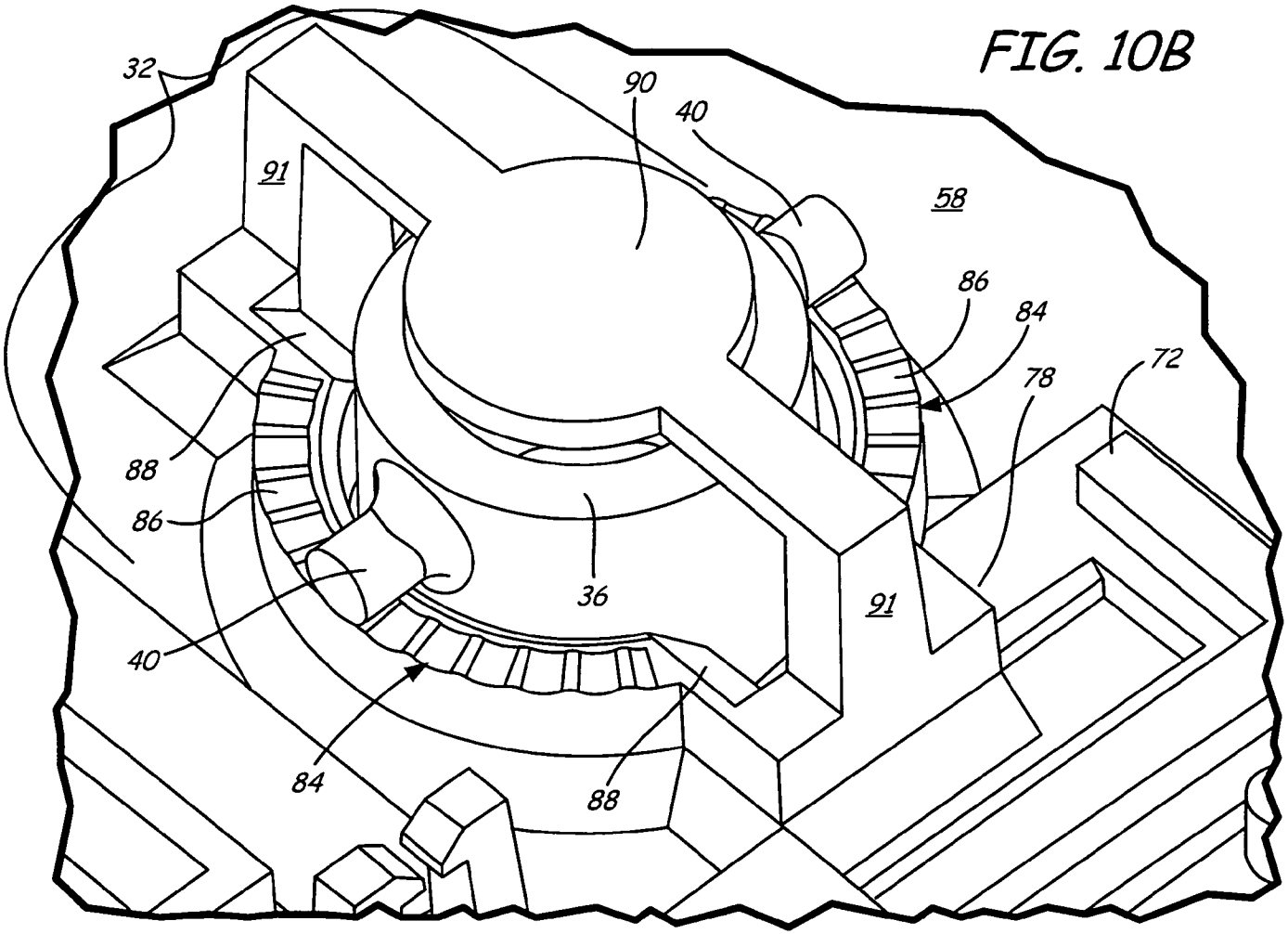

FIG. 10B illustrates the attachment stud 14 after the life safety device 12 has been rotated. The life safety device 12 is rotated such that the mounting tabs 40 engage with and align on the wave-like detents 86 of the collar halves 84. Gravitational force, a force supplied by the base plate 34 of the attachment stud 14 contacting the base surface 18, an opposing force created by the compressible material, interlocking shapes, and/or an interference fit, may be used individually or in combination to keep the interlocking features of the stud 14 and the life safety device 12 engaged. Although a pair of mounting tabs 40 are portrayed in FIG. 10B, a single tab or key (or three or more tabs or keys) may be used to mount the life safety device 12 to the attachment stud 14 by interlocking with the receptacle 32. Other forms of interlock elements of receptacle 32, may be utilized to engage the mounting tabs 40.

In the embodiment shown in FIG. 10B, collar halves 84 additionally include ramps 88. The ramps 88 are located adjacent the keyways 82. The ramps 88 make rotation of the life safety device 12 onto the attachment stud 14 less difficult during installation by allowing the base plate 34 or base foam 42 of the attachment stud 14 an initial distance and time to compress before the life safety device 12 is fully rotated to an engagement position with the collar halves 84. The ramps may also be used to guide the mounting tabs 40 to an engagement position with the collar halves 84 of the stud 14 as the life safety device 12 is rotated. The mounting tabs 40 ride up the ramps 88 into the interlock detent region of the collar halves 84 during mounting of the life safety device 12, and ride down the ramps 88 to the keyways 82 during disengagement and removal of the life safety device 12. The mounting tabs 40 need not be rotated to a 90 degree angle of engagement with the collar halves 84 (using the post 36 axis of symmetry as a reference axis) as illustrated in FIG. 10B. Other angles of engagement including a plurality of angles above and below 90 degrees may be used to achieve cosmetic alignment of the assembly 10. In the event that a non-circular life safety device 12 is used, cosmetic alignment of the assembly 10 may occur by aligning an edge on the front cover 20 or base surface 18 of the life safety device 12 with a parallel surface.

Although the present invention has been described with reference to preferred embodiments, workers skilled in the art will recognize that changes may be made in form and detail without departing from the spirit and scope of the invention.

The invention claimed is:

1. A life safety assembly, comprising:

an attachment stud configured to attach to a wall or ceiling surface using a single screw, wherein the attachment stud comprises a center of the attachment stud, wherein the attachment stud comprises a hollow post located at the center of the attachment stud and configured to receive the single screw to attach the attachment stud to the surface; and a life safety device including a receptacle configured to receive and interlock with the attachment stud and receive the hollow post projecting into an interior of the receptacle to mount the life safety device with respect to the surface;

wherein the attachment stud is rotatable about an axis defined by the single screw prior to a tightening of the single screw without changing a mounted position of the life safety device;

wherein the life safety device is rotatable to a plurality of positions to engage the attachment stud;

wherein the hollow post comprises a post projection with a mounting tab projecting from the side of the hollow post, the mounting tab configured to interlock with the receptacle.

2. The life safety assembly of claim 1, further comprising a lockout mechanism that obstructs an opening of the receptacle when a battery is not installed in a battery compartment on the life safety device.

3. The life safety assembly of claim 1, wherein the attachment stud has an alignment mark.

4. The life safety assembly of claim 1, wherein the life safety device is non-circular in shape.

5. The life safety assembly of claim 1, wherein the receptacle has a stop to indicate a position adequate to interlock the attachment stud with the receptacle has been obtained.

6. The life safety assembly of claim 1, wherein the receptacle has a collar with a plurality detents, the detents and collar configured to interlock with the mounting tab.

7. The life safety assembly of claim 1, wherein the attachment stud or the life safety device has a compressible material affixed to the life safety device or the attachment stud, the compressible material capable of creating an opposing force between the life safety device and the attachment stud when the life safety device and the attachment stud are interlocked.

8. The life safety assembly of claim 1, wherein the attachment stud has a base plate with a base foam attached to the base plate, the base foam capable of compressing against the life safety device to provide a force that interlocks the attachment stud with the receptacle.

9. The life safety assembly of claim 1, wherein the attachment stud has an attachment cleat, the attachment cleat configured to provide traction for the attachment stud on the wall or ceiling surface.

10. A method of mounting a life safety device, the method comprising:

mounting an attachment stud to a surface using a single screw, wherein the attachment stud comprises a center of the attachment stud, wherein the attachment stud comprises a hollow post located at the center of the attachment stud and configured to receive the single screw to attach the attachment stud to the surface;

mounting a life safety device onto the attachment stud so that the hollow post projects into an interior of a receptacle in the life safety device;

rotating the attachment stud about an axis defined by the single screw prior to a tightening of the single screw without changing a mounted position of the life safety device; and rotating the life safety device about an axis defined by the stud to a position in which the stud and the receptacle are interlocked;

wherein the receptacle defines a plurality of circumferentially spaced locking positions;

wherein the attachment stud is provided with a mounting tab projecting from the side of the hollow post, the mounting tab configured to interlock with the receptacle.

11. The method of mounting of claim 10, wherein the receptacle is provided having a collar with a plurality of detents, the detents and collar configured to interlock with the mounting tab.

12. The method of mounting of claim 10, further comprising aligning the attachment stud to a surface substantially parallel to an alignment mark on the attachment stud.

13. The method of mounting of claim 10, further comprising inserting batteries into a battery compartment of the life safety device such that a lockout mechanism does not obstruct the receptacle.

* * * * *